US005836802A

United States Patent [19]

Harnett

[11] Patent Number: 5,836,802

[45] Date of Patent: Nov. 17, 1998

[54] INTERACTIVE FIGURE TOY

[76] Inventor: David B. Harnett, 316 Miami Dr., Keswick, Ontario, Canada, L4P 2Z7

[21] Appl. No.: 901,007

[22] Filed: Jul. 28, 1997

[51] Int. Cl.[6] ..... A63J 19/00

[52] U.S. Cl. ..... 446/367; 446/97; 446/334; 446/359

[58] Field of Search ..... 446/334, 336, 446/359, 366, 367

[56] References Cited

U.S. PATENT DOCUMENTS

| | | | |
|---|---|---|---|
| 423,066 | 3/1890 | Massey | 446/73 |
| 1,452,820 | 4/1923 | Whitcomb et al. | 446/334 |
| 1,501,912 | 7/1924 | Meehan | 446/366 |
| 2,144,751 | 1/1939 | Brown | 446/73 |
| 3,195,265 | 7/1965 | Marquez et al. | 446/73 |
| 4,054,006 | 10/1977 | Estlund | 446/366 |

FOREIGN PATENT DOCUMENTS

| | | | |
|---|---|---|---|
| 3943144 | 7/1991 | Germany | 446/366 |

*Primary Examiner*—Robert A. Hafer
*Assistant Examiner*—Jeffrey D. Carlson
*Attorney, Agent, or Firm*—David W. Wong

[57] ABSTRACT

The interactive animated figure toy is formed with few commonly available component parts. Various interesting figures may be selectively formed by stringing a plurality of bead elements together with elastic bands. The figure is mounted on two elongated supporting rods such that it may be actuated to perform interesting and entertaining responsive actions with the operation of the supporting rods.

18 Claims, 3 Drawing Sheets

INTERACTIVE FIGURE TOY

BACKGROUND OF THE INVENTION

This invention relates to action figure toys and particularly to an interactive animated figure toy which is operative to provide highly entertaining responsive actions.

A figure toy commonly consists of an animated figure of such as a human or animal figure formed with a plurality of component parts of the figure mounted together mechanically. In order to provide a high degree of amusement and excitement to the player, certain parts of the toy may be operative to perform selected interesting actions. Some animated figures such as play dolls commonly have complex mechanical linkages to various movable parts provided such that entertaining actions of a selective part or several parts may be instigated in the doll by operating actuating levers or other variable components provided therein. Animated figures having a relatively simple construction normally can only perform a very simple and often uninteresting action that is not particularly entertaining, while more complex animated figures can produce a variety of more interesting and highly entertaining actions; however, the latter inherently tend to be also complex in construction, and therefore are expensive and time consuming to fabricate. Furthermore, known figure toys are generally constructed with special component parts, accordingly they are usually difficult and costly to repair.

SUMMARY OF THE INVENTION

It is a principal object of the present invention to provide an interactive action toy which is operative to provide highly entertaining and exciting actions.

It is another object of the present invention to provide an interactive action toy which comprises of few and commonly available components and yet it is attractive in appearance.

It is another object of the present invention to provide an interactive action toy which is simple in construction and easy to fabricate and repair.

It is still another object of the present invention to provide an interactive action toy having one figure or two figures which may be easily operated to perform entertaining and exciting actions.

Briefly, the interactive action toy of the present invention has at least one animated figure mounted on two elongated supporting rods. The animated figure comprises of a plurality of bead elements in which each bead element has a through channel extending from one side therein to its opposite side. The bead elements are mounted together by a plurality of elastic bands to form, for example, an animated human figure having two legs, two arms, a body portion and a head. The two legs are respectively mounted to the two elongated supporting rods. A motion staff such as a hockey stick is mounted to the end of the arms. The position of the motion staff may be varied by operating the supporting rods; and they may also be actuated to perform various interactive actions by moving the supporting rods with a push and pull reciprocating movement and/or an up and down movement.

DESCRIPTION OF THE DRAWINGS

Other objects of this invention will appear in the following description and appended claims, reference being made to the accompanying drawings in which

DETAILED DESCRIPTION OF THE PREFERRED EMBODIMENTS

Figure 1:
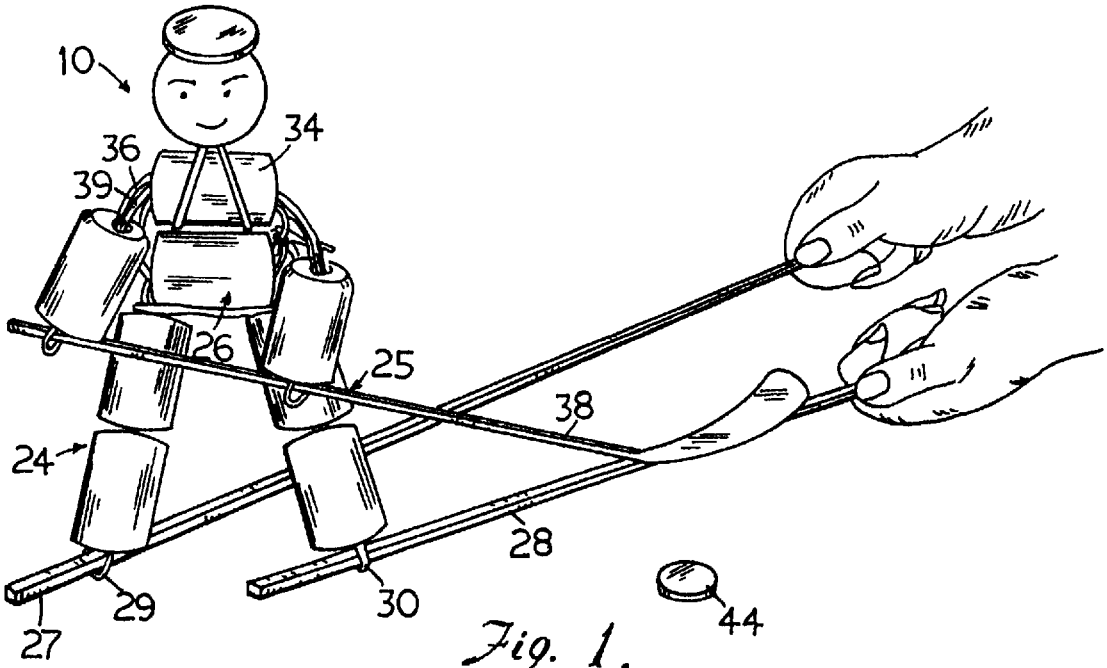
FIG. 1 is a perspective front elevation view of an animated hockey player figure toy according to the present invention.
Figure 2:
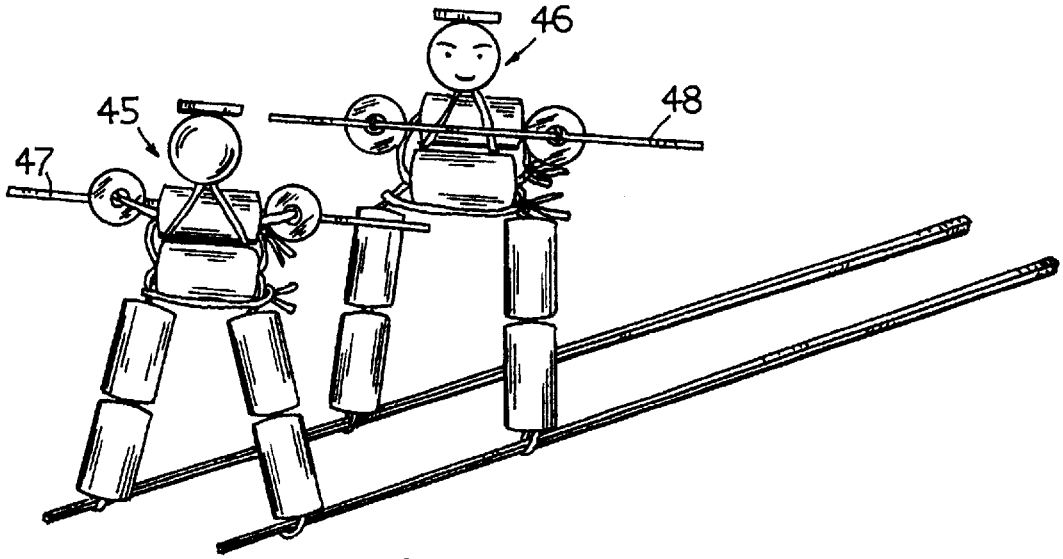
FIG. 2 is a perspective front elevation view of two animated combating warriors of the figure toy according to the present invention.

With reference to the drawings wherein like reference numerals designate corresponding parts in the several views, the figure toy of the present invention may be provided with a single animated figure such as an animated hockey player 10 as shown in FIG. 1 or two animated figures such as two combat warriors 11 and 12 as shown in FIG. 2. It will be appreciated by those skilled in the art that a large variety of interesting figures may be constructed according to the present invention. The figures shown serve only as examples for illustration.

Figure 3:
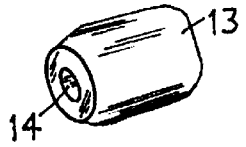
FIG. 3 is a perspective front elevation view of the bead element for constructing the animated figure according to the present invention.
Figure 4:
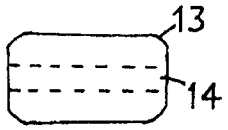
FIG. 4 is a perspective side elevation view of the bead element with the through channel therein shown in dotted lines.
Figure 5:
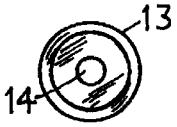
FIG. 5 is the end elevation of the bead element thereof.
Figure 6:
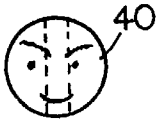
FIG. 6 is a perspective front elevation view of the spherical head element of the figure toy according to the present invention with the through channel therein shown in dotted lines.
Figure 7:
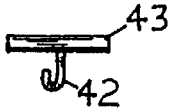
FIG. 7 is a perspective front elevation view of the hat element of the figure toy.
Figure 8:
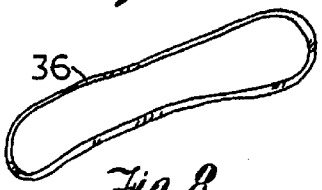
FIG. 8 is a perspective front elevation view of the elastic band for constructing the figure toy according to the present invention.
Figure 9:
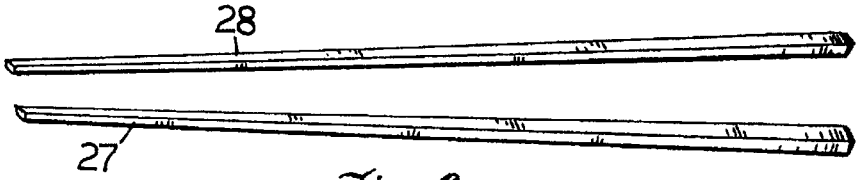
FIG. 9 is a perspective front elevation view of the supporting rods.

The animated figure is constructed with a plurality of generally cylindrical bead element 13 as shown in FIGS. 3 through 5. The bead element 13 has a central through channel 14 extending through its entire length from one end to the opposite end.

For simplicity of illustration, the construction of a single animated figure according to the present invention is shown in FIGS. 10 through 17. An elongated elastic cord such as a general purpose elastic band 15 is first threaded through a row of five bead elements 16, 17, 18, 19 and 20. A fabrication hook 21 may be used for assisting the assemblage of the figure toy. The fabrication hook 21 has a long handle portion 22 with a hook 23 formed at one end. The size of the hook 23 is smaller than the diameter of the through channel 14 of the bead elements so as to facilitate the threading of the elastic band 15 through the bead elements. Preferably, the elastic band 15 is folded to form a double band in order to provide a stronger support and link among the bead elements 16, 17, 18, 19 and 20 which subsequently will form the legs 24 and 25 and the lower torso 26 of the animated figure. Two elongated supporting rods 27 and 28 are mounted to the two ends 29 and 30 of the elastic band 15 by simply looping these ends onto the elongated supporting rods 27 and 28 respectively. The mounting is located closer to one end of the supporting rods 27 and 28 such that the other end of the supporting rods may be used later for operating the animated figure.

Figure 13:
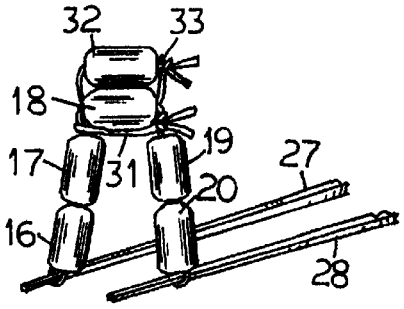
Figure 14:
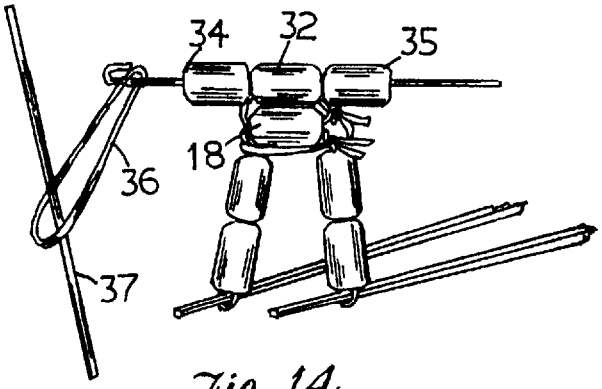

After the supporting rods 27 and 28 are mounted to the strung together bead elements 16, 17, 18, 19 and 20, the two bead elements 16 and 17 located on one side of the center bead element 18 and the other two bead elements 19 and 20 disposing on the other side of the center bead element 18 are respectively bent downwards relative to the center bead element 18 to form a substantially V-shaped configuration with the center bead element 18 now disposes in the horizontal position to form the lower torso 26 of the animated figure while the downwardly bent bead elements 16, 17 and 19, 20 formed respectively the two legs 24 and 25 of the figure. In order to maintain the legs 24 and 25 in the downward positions, second elastic band 31 which serves as a restraining band is tied over the joints between the bead elements 17, 19 and the horizontal center bead element 18. The degree in which the legs are bent downwards depends on the tightness of which the elastic band 31 is tied over the joints. The elastic band 31 may be looped, twisted and relooped twice around the center bead element 18 to ascertain such a tight binding. Alternatively, a wire instead of the elastic band 31 may be used for binding the legs. After winding around the joints, the wire ends are twisted together and snipped. The twisted snipped end is bent and tucked between the legs. A second horizontal bead element 32 is then secured on top of the center bead element 18 by a third elastic band 33 to form the upper torso 34 of the figure. The third elastic band 33 is threaded through the through channels of the center bead element 18 and the second horizontal bead element 32; and after they have been tied together with a knot formed in the elastic band 33, the loose free ends of the third elastic band 33 may also dispose at the side of the figure to simulate the upper belt of the figure as best shown in FIG. 13.

Figure 10:
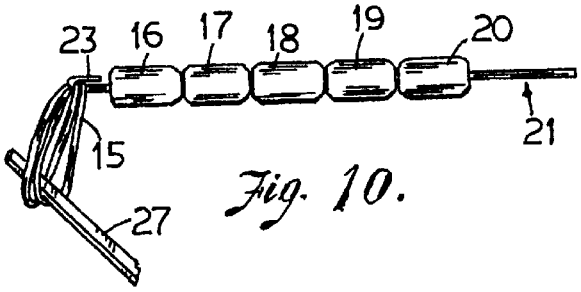
FIGS. 10 through 17 are perspective elevation views showing the method of fabricating the figure toy according to the present invention.
Figure 11:
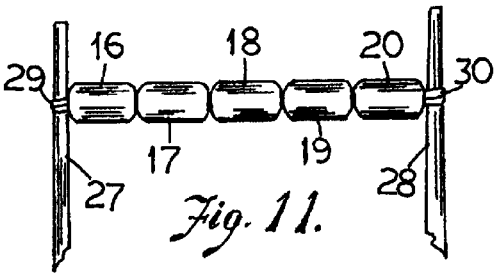
Figure 12:
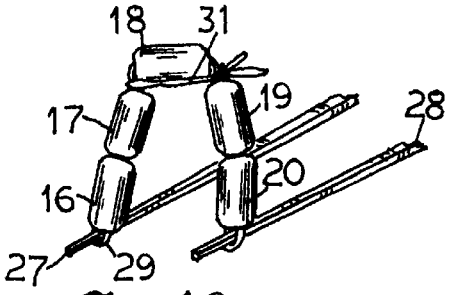
Figure 15:
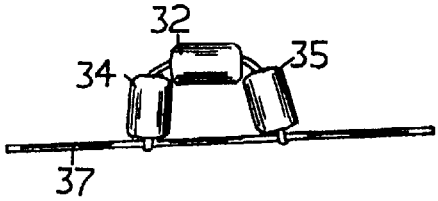
Figure 16:
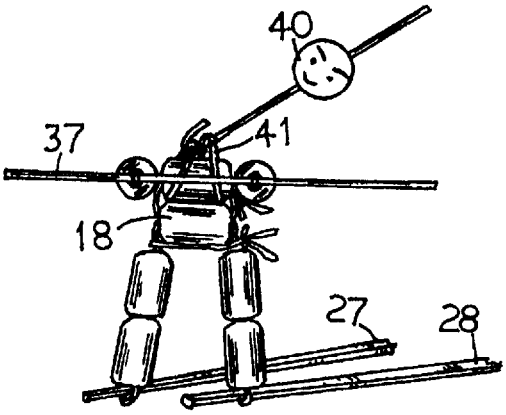
Figure 17:
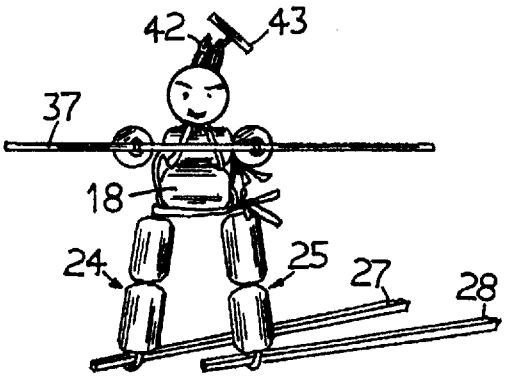

After the formation of the upper torso, two additional horizontal bead elements 34 and 35 are strung to the two sides of the upper torso of the FIG. 10 by a fourth elastic band 36 threaded through the aligned through channels of the horizontal bead elements 34, 32, and 35. A staff 37 is first placed within the elastic band 36 such that after the elastic band 36 is threaded through the horizontal bead members 32, 34, and 35, the tension in the elastic band 36 will retain the staff 37 mounted juxtaposed to the bead element 34. After the elastic band 36 has been threaded through the bead elements 34, 32 and 35 with the fabrication hook 21, the bead elements 34 and 35 are bent forward to form the out-stretched arms of the figure. The other end of the elastic band 36 is then pulled under tension to extend outside of the bead member 35 to engage with the other end of the staff 37 such that the staff 37 becomes mounted to the ends of the arms of the figure; and it also retains the arms in the out-stretched forward position as best shown in FIG. 15. Alternatively, two short dowels may be used for assembling the arms to the upper torso. The first dowel is first inserted into the elastic band 36 before the latter is threaded through the bead elements 34, 32 and 35. After the elastic band 36 has been inserted through the bead elements 34, 32, and 35, the other end of the elastic band 36 is pulled under tension to extend outside of the bead element 35 to engage with the second short dowel so as to retain the bead elements 34, 32, and 35 mounted together. Thereafter, the bead elements 34 and 35 are bent forward and the staff 37 is then inserted into the two looped end of the elastic band 36 extending outside of the arms while the dowels are being removed therefrom so as to mount the staff 37 onto the arms as well as retaining the arms in the out-stretched manner. A hockey stick 38 may be mounted on to the arms in the same manner. In order to maintain the hockey stick in a selected position such as a hockey puck shooting position as shown in FIG. 1, a heavy gauge wire 39 is also threaded through the bead elements 34, 32, and 35 so that the wire 39 may be bent to retain the arms, in turn, the hockey stick 38 in the desirable position. Following the formation of the upper torso of the FIG. 10, a spherical head element 40 is mounted on top of the upper torso bead member 32 by inserting a fifth elastic band 41 under the upper torso bead element 32 such that this fifth elastic band 41 wraps around the underside of the upper torso bead element 32 with its two looped ends extending upwards. The ends of the fifth elastic band 41 are threaded and pulled under tension with the aid of the fabrication hook 21 to extend upwards through the through channel of the spherical head element 40 for engaging with the hook portion 42 of a hat element 43. In this manner, the hat element 43 is mounted on top of the spherical head element 40; meanwhile the hat element 43 engaging with the fifth elastic band 41 under tension also, in turn, maintains the spherical head element 40 securely mounted to the upper torso bead element 32. A face may be painted on the front surface of the spherical head element 40 to simulate the face of the figure.

Alternatively, a common button having openings therein may be used as the hat element 43. The button is mounted by using a fabrication hook having a hook smaller than the button openings. The hook is inserted through an opening in the button to pull the ends of the fifth elastic band 41 therethrough and a small diameter dowel is then inserted through the looped end of the fifth elastic band 41 to hold the button in place. After secured in place, the small dowel may then be trimmed to the size of the button.

Due to the tension in all the elastic bands, all the bead elements are strung together securely. Furthermore, any movement applied on one part of the figure will inherently cause an interactive responsive reaction from other parts of the figure. Accordingly, the figure may be operated to raise and swing the staff 37 by exerting push-pull and up and down movements by hands by the player on the supporting rods so as to perform the action of shooting a hockey puck 44 as best shown in FIG. 1.

Two combating warriors 45 and 46 facing one another in the opposite manner may be provided as best shown in FIG. 2 with the warriors holding respectively fighting lances 47 and 48. The warriors will combat each other with the exciting and entertaining combatting movement of the lances when the push and pull and/or up and down movements are applied on the supporting rods.

The components for constructing the figure toy of the present invention are commonly available parts. For example, the bead elements may be wooden beads with the through channel drilled therein. The bead elements typically may have an outside diameter of about half an inch and about three quarter of an inch long. General purpose elastic bands such as #36 size elastic bands may be used for stringing the bead elements together; and wooden chopsticks may be used as the supporting rods.

Figure 18:
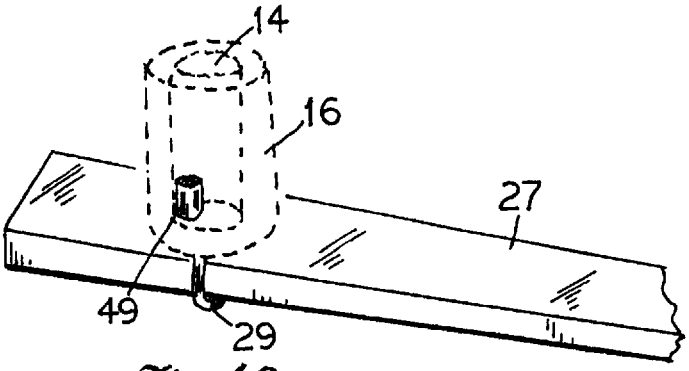
FIG. 18 shows an isolated enlarged perspective view of the provision of a dowel in the supporting rod for mounting the figure securely to the supporting rod.

As best shown in FIG. 18, a short dowel 49 may be provided on the supporting rods 27 and 28 to enhance the securement of the FIG. 10 to the supporting rods. The short dowel 49 engages with the lower portion of the through channel of the bead elements 16 and 20 of the legs to prevent any potential that the legs may slide out of engagement with the supporting rods under operation of the toy.

Furthermore, the number of bead elements used in the above illustration in forming the various parts of the figure may be varied to provide a figure of a selected shape. For example, one bead element instead of two bead elements may be provided on each side of the lower torso bead element to form a figure with shorter legs. Similarly, more bead elements may be employed to form longer arms or torso.

While the present invention has been shown and described in the preferred embodiments thereof, it will be apparent that various modifications can be made therein without departing from the spirit or essential attributes thereof, and it is desired therefore that only such limitations be placed thereon as are imposed by the appended claims.

I claim:

1. An interactive figure toy having at least one animated figure comprising, a plurality of bead elements strung together with an elongated first resilient band under tension, said bead elements including a center bead element disposed in a substantially horizontal position and a first bead element located on one side of said center bead element, and a second bead element located on the other side of said center bead element, a first elongated rod member secured to one end of said first resilient band extending outside of said first bead element, a second elongated rod member secured to the other end of said first resilient band extending outside of said second bead element, a restraining band tied over joints between said center bead element and said second bead element for retaining said first bead element and said second bead element to dispose downwardly relative to said center bead element and forming a substantially V-shaped configuration therewith, a third bead element mounted on top of said center bead element, a fourth bead element and a fifth bead element mounted in a substantially perpendicular manner to said third bead element by a second resilient band, said second resilient band having one end extending outside a front end of said fourth bead element, and a second end extending outside a front end of said fifth bead element, an elongated staff member mounted to said fourth bead element and fifth bead element and engaged with said one end and said second end of said second resilient band, a spherical bead element mounted on top of said third bead element with a third resilient band, and a hat member mounted on top of said spherical bead element and engaged with said third resilient band.

2. An interactive figure toy according to claim 1 wherein said plurality of bead elements are substantially cylindrical bead elements having a through channel extending throughout the entire longitudinal length therein, and said center bead element, first bead element and second bead element being strung together by said first resilient band extending through the through channels of said center bead element, said first bead element and said second bead element.

3. An interactive figure toy according to claim 2 wherein said resilient band is an elastic band.

4. An interactive figure toy according to claim 3 wherein said third bead element is mounted to said center bead element by an additional elastic band threaded through the through channels of said third bead element and said center bead element, and said additional elastic band having two loose ends tied together is a knot.

5. An interactive figure toy according to claim 4 wherein said fourth bead element and said fifth bead element are strung together by said second resilient band extending through the through channels of said fourth bead element, said fifth bead element and said third bead element.

6. An interactive figure toy according to claim 5 wherein said spherical bead element includes a through channel extending throughout its entire diameter, and said third resilient band is an elastic band extending underneath said third bead element, said third resilient band having two mounting ends extending upwards through said through channel of said spherical bead element to engage with said hat member for mounting said hat member and said spherical bead element on said third bead member.

7. An interactive figure toy according to claim 6 wherein said hat member includes a hook-shaped leg extending downwardly therefrom to engage with said mounting ends of said third resilient band extending under tension through said through channel of said spherical bead element.

8. An interactive figure toy according to claim 6 wherein said hat member includes a mounting opening, and a looped end of said third resilient band extending under tension through said through channel of said spherical bead element and said mounting opening of said hat member to engage with a mounting dowel for mounting said hat member in place.

9. An interactive figure toy according to claim 8 including a retaining dowel member provided on said first elongated rod member and said second elongated rod member, said retaining dowel member engaged with the through channel of said first bead element and said second bead element respectively.

10. An interactive figure toy according to claim 9 wherein said restraining band is a binding wire.

11. An interactive figure toy according to claim 10 including a heavy gauge wire inserted through said third bead element, fourth bead element and fifth bead element, said heavy gauge wire being bendable to position the fourth bead element and fifth bead element in selected positions relative to said third bead element.

12. An interactive figure toy according to claim 11 wherein said staff member is a simulated hockey stick.

13. An interactive figure toy having two animated figures mounted on two elongated rod members, each animated figure comprising five substantially cylindrical bead elements mounted together with a first elastic band, said bead elements having a through channel extending throughout the entire longitudinal length therein, and said first elastic band extending through the through channel of said five bead elements, said five bead elements including a center bead element disposed in a substantially horizontal position, a second bead element and a third bead element in combination disposed on one side of said center bead element, and a fourth and a fifth bead element in combination disposed on a second side of said center bead element, said second bead element, third bead element, fourth bead element and fifth bead element forming a substantially V-shaped configuration with said center bead element, said first rod member being secured to one end of said first elastic band extending outside of said second bead element, said second rod member being secured to a second end of said first elastic band extending outside of said fifth bead element, a restraining band disposed on joints between said center bead element and said fourth bead element and third bead element for retaining said V-shaped configuration, a sixth bead element disposed in a horizontal manner over said center bead element and being mounted thereon by a second elastic band extending threading through the through channels of said sixth bead element and center bead element, a seventh bead element disposed perpendicularly at one side of said sixth bead element, an eighth bead element disposed perpendicularly at a second side of said sixth bead element, said sixth bead element, seventh bead element and eighth bead element being strung together by a third elastic band threaded under tension through channels of said sixth bead element, seventh bead element and eight bead element, an elongated staff member mounted front ends of said seventh bead element and eighth bead element and engaging with ends of said third elastic band extending outside of said seventh bead element and eight bead element, a spherical bead element mounted on top of said sixth bead element by a fourth elastic band extending underneath said sixth bead element, said fourth elastic band having two mounting ends extending upwardly through a vertical through channel in said spherical bead element, a hat button disposed on top of said spherical bead element, said fourth elastic band extending through said vertical through channel of said spherical bead element to engage with said hat button for mounting said hat button and said spherical bead element to said sixth bead element.

14. An interactive figure toy according to claim 13 wherein said hat button includes a hook-shaped leg extending downwardly through said vertical through channel of said spherical bead element to engage with said two mounting ends of said fourth elastic band.

15. An interactive figure toy according to claim 14 wherein said hat button includes mounting openings, and said two mounting ends of said fourth elastic band extending through said mounting openings to engage with a mounting dowel disposed on said hat button for mounting said hat button and said spherical bead element on said sixth bead element.

16. An interactive figure toy according to claim 15 wherein said animated figures are facing each other.

17. An interactive figure toy according to claim 16 including a first retaining dowel provided on said first rod member and a second retaining dowel provided on said second rod member, said first retaining dowel engaging with the through channel of said second bead element, and said second retaining dowel engaging with the through channel of said fifth bead element.

18. An interactive figure toy according to claim 17 wherein said animated figures are mounted close to one end of said first rod member and second rod member.

* * * * *